United States Patent [19]

Onishi

[11] Patent Number: 4,864,998

[45] Date of Patent: Sep. 12, 1989

[54] FUEL-INJECTION SYSTEM OF AN INTERNAL COMBUSTION ENGINE

[75] Inventor: Akito Onishi, Toyota, Japan

[73] Assignee: Toyota Jidosha Kabushiki Kaisha, Aichi, Japan

[21] Appl. No.: 223,631

[22] Filed: Jul. 25, 1988

[30] Foreign Application Priority Data

Aug. 11, 1987 [JP] Japan ..... 62-200338

[51] Int. Cl.[4] ..... F02D 41/14; F02D 41/26

[52] U.S. Cl. ..... 123/489; 123/480; 123/494; 364/431.05; 364/431.11

[58] Field of Search ..... 123/489, 479, 480, 486, 123/494; 364/431.05, 431.11

[56] References Cited

U.S. PATENT DOCUMENTS 4,497,297 2/1985 Daniel et al. ..... 123/489

FOREIGN PATENT DOCUMENTS 59-63328 4/1984 Japan ..... 123/489

61-28739 2/1986 Japan .

*Primary Examiner*—Andrew M. Dolinar

*Attorney, Agent, or Firm*—Kenyon & Kenyon

[57] ABSTRACT

A fuel injection system of an internal combustion engine in which the fuel injection amount is controlled corresponding to an atmospheric pressure change by utilizing an altitude compensating learning correction factor stored in a backup RAM. Even thought a battery is disconnected from the memory of the backup RAM and the stored data of the learning correction factor is lost, the altitude compensating learning correction factor is directly determined based on the atmospheric pressure without executing learning control so that the fuel injection amount is corrected at the time of the initial cranking of the engine.

7 Claims, 12 Drawing Sheets

FUEL INJECTION SYSTEM OF AN INTERNAL COMBUSTION ENGINE

BACKGROUND OF THE INVENTION

The present invention relates to a fuel injection system of an internal combustion engine for calculating a fuel injection amount based on a suction air amount of the engine which is detected by an air flow meter. Particularly, the invention relates to a fuel injecting method in which a standard fuel injection amount is corrected based on an altitude compensating learning correction factor corresponding to a change in an atmospheric pressure.

Generally, as the altitude becomes higher, i.e., as the air pressure becomes lower, the measured value of suction air detected by the air flow meter becomes larger than the actually admitted amount. In order to correct the detected value of the suction air amount, a control method has been proposed. It is such that a learning correction factor corresponding to a change in atmospheric pressure is stored in a memory of a backup RAM and a standard fuel injection amount is corrected based on the learning correction factor. The learning correction factor is always updated during engine operation. In this method, however, the learning correction factor stored in the memory is erased when a battery is demounted from the vehicle for replacement or charging so that feeding to the backup RAM is discontinued. When the engine is started after mounting the battery, therefore, it is impossible to immediately execute the fuel injection amount control based on the learning correction factor. Consequently, much time is required until the optimum fuel injecting amount corresponding to the atmospheric pressure is determined again.

To cope with this problem, a learning factor controlling method for an internal combustion engine has been disclosed in Japan published unexamined patent application No. 61-28739. In this art, a computer detects discontinuation of feeding to the backup RAM due to disconnection from the battery. When the battery is connected and the engine s started again, the computer acts to expedite the updating time interval of the learning factor so as to immediately restore the appropriate value of the learning correction factor. This art, however, includes another problem. Since the optimum amount of fuel corresponding to the atmospheric pressure cannot be injected from the initial starting of the engine, the air/fuel ratio cannot be controlled to immediately approach a desired air/fuel ratio, e.g., the stoichiometric air/fuel ratio.

SUMMARY OF THE INVENTION

It is an object of the present invention to provide an electronic controlled fuel injection system in which the fuel injecting amount is optimally determined corresponding to the atmospheric pressure even after the learning correction factor is lost.

To achieve this and other objects, the electronic controlled fuel injection system of the present invention includes: an air flow meter for measuring a suction air amount; an engine speed sensor for sensing a rotating speed of the engine; basic amount calculation means responsive to the sensed suction air amount and the sensed engine speed for calculating a basic fuel injecting amount for realizing a given target air/fuel ratio in a combustion chamber of the engine; an oxygen sensor for sensing an oxygen content of an exhaust gas of the engine; a memory for storing a learning correction factor, the memory being backed up by a battery; correction factor calculation means for calculating the learning correction factor based on the sensed oxygen content and the previously calculated learning correction factor stored in the memory in order to compensate a deviation from the target air/fuel ratio due to a change in an atmospheric pressure; injection amount calculation means for calculating a fuel injecting amount of the engine based on the basic fuel injecting amount and the learning correction factor; disconnection detection means for detecting a disconnection between the memory and the battery when the engine is not operating; an air pressure sensor for sensing the atmospheric pressure; and correction factor setting means for setting an initial learning correction factor based on the sensed atmospheric pressure and for storing the initial learning correction factor in the memory before the engine is started when a connection between the memory and the battery is restored after the disconnection is detected.

The fuel injecting method according to the fuel injection system of the present invention is outlined as follows.

When power is continuously supplied to the memory (backup RAM) for retaining the stored data of the altitude compensating learning correction factor, a basic fuel injection amount is corrected based on at least the stored learning correction factor. The basic fuel injection amount is calculated according to a ratio of a suction air amount detected by an air flow meter to a rotation speed of the internal combustion engine. By executing the abovementioned correction or other correction as needed, a final fuel injection amount (injecting time of the injection valve) is determined to inject fuel. Thus, normal operation of the internal combustion engine corresponding to the atmospheric pressure can be realized. The learning correction factor is always updated during the engine operation and stored in the memory.

If, however, electric power to the memory, for retaining the data of the above mentioned learning correction factor, is disconnected when the internal combustion engine is not operating, the latest stored correction factor is lost. When the battery is connected again, the atmospheric pressure is detected before the engine is started and the altitude compensating learning correction factor is directly determined based on the atmospheric pressure without learning control. The abovementioned correction factor is then stored in the backup RAM. Since the basic fuel injection amount is corrected based on the atmospheric pressure from the initial starting of the internal combustion engine so as to determine the final fuel injection amount (injecting time), normal operation of the internal combustion engine corresponding to the atmospheric pressure can be obtained at all times.

BRIEF DESCRIPTION OF THE DRAWINGS

By way of example and to make the description clearer, reference is made to the accompanying drawings in which.

DETAILED DESCRIPTION OF PREFERRED EMBODIMENT

A preferred embodiment of the present invention is set forth with reference to the attached drawings.

Figure 1:
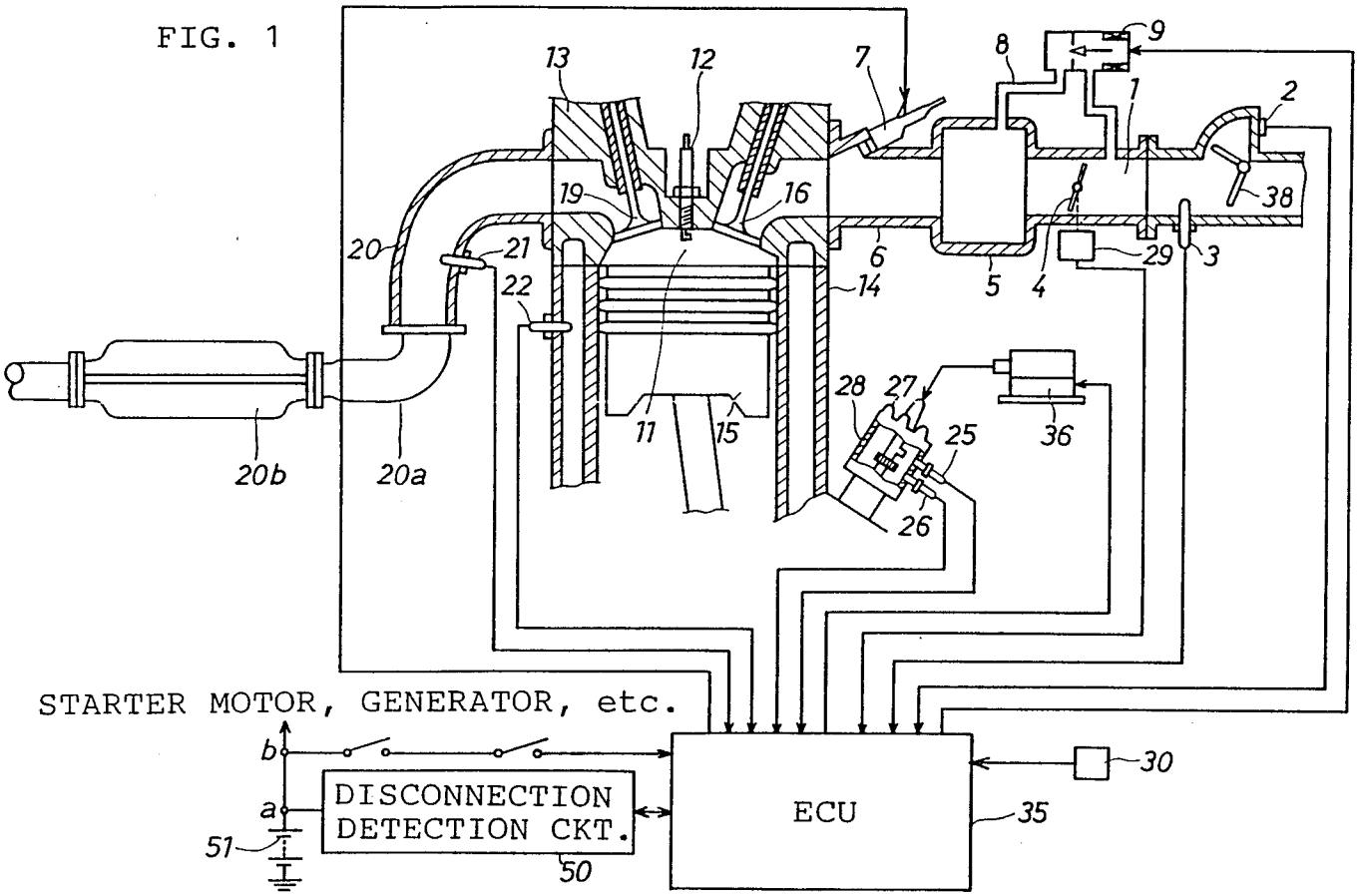
FIG. 1 is a schematic view illustrating an internal combustion engine utilizing an electronic controlled fuel injection system of the present invention and its peripheral equipments.

As shown in FIG. 1, a suction pipe 1 is provided with an air flow meter 2, an air temperature sensor 3, a throttle valve 4, a surge tank 5 and an intake manifold 6 arranged in order along the flow direction of the suction air. The intake manifold 6 is equipped with a fuel injection valve 7 for supplying fuel to a suction port. A bypass air path 8 is arranged alongside of the part where the throttle valve 4 is provided in the suction air pipe 1. The suction area of the bypass air path 8 is controlled by an idle speed control (ISC) valve 9. Moreover, an air pressure sensor 30 for detecting atmospheric pressure is provided in a cabin. A combustion chamber 11 being equipped with an ignition plug 12 is configured by a cylinder head 13, a cylinder block 14 and a piston 15. Air-fuel mixture is supplied via a suction valve 16 to the combustion chamber 11. The mixture burned in the combustion chamber 11 is discharged via an exhaust valve 19 to an exhaust manifold 20. A three-way catalytic converter 20*b* for purifying the exhaust gas is attached to a downstream part 20*a* of the exhaust manifold 20. An oxygen sensor 21 detects an oxygen content of the exhaust gas. When the air/fuel ratio is smaller than the stoichiometric air/fuel ratio (i.e., when fuel rich), the sensor 21 outputs a high level signal. On the other hand, when the detected air/fuel ratio is larger than the stoichiometric air/fuel ratio (i.e., when fuel lean), it outputs a low level signal.

A water temperature sensor 22 is attached to a cylinder block 14 to detect a cooling water temperature. A cylinder sensor 25 and a rotating angle sensor 26 which also acts as a rotating speed sensor output pulse signals for every change in crankshaft angle of 720° and 30°, respectively, corresponding to the rotation of an axis 28 of a distributor 27. Thus, the cylinders of the combustion engine are discriminated and the rotating speed of the engine is detected. A throttle sensor 29 incorporates an idle switch (LL switch) to detect the idle condition and the throttle valve opening. When the throttle valve is completely closed, the LL switch is turned on.

An electronic control unit (ECU) 35 inputs signals sent from the above-mentioned various sensors and outputs signals to the fuel injection valve 7, the ISC valve 9 and an ignition coil 36. Secondary current of the ignition coil 36 is supplied via the distributor 27 to the ignition plug 12. The air flow meter 2 detects suction air amount by a known method utilizing a tilting angle of a measuring plate 38. To a terminal a of a battery 51, a disconnection detection circuit 50 is connected for detecting and storing information that power to the ECU 35 is discontinued when the terminal a is disconnected.

Figure 2:
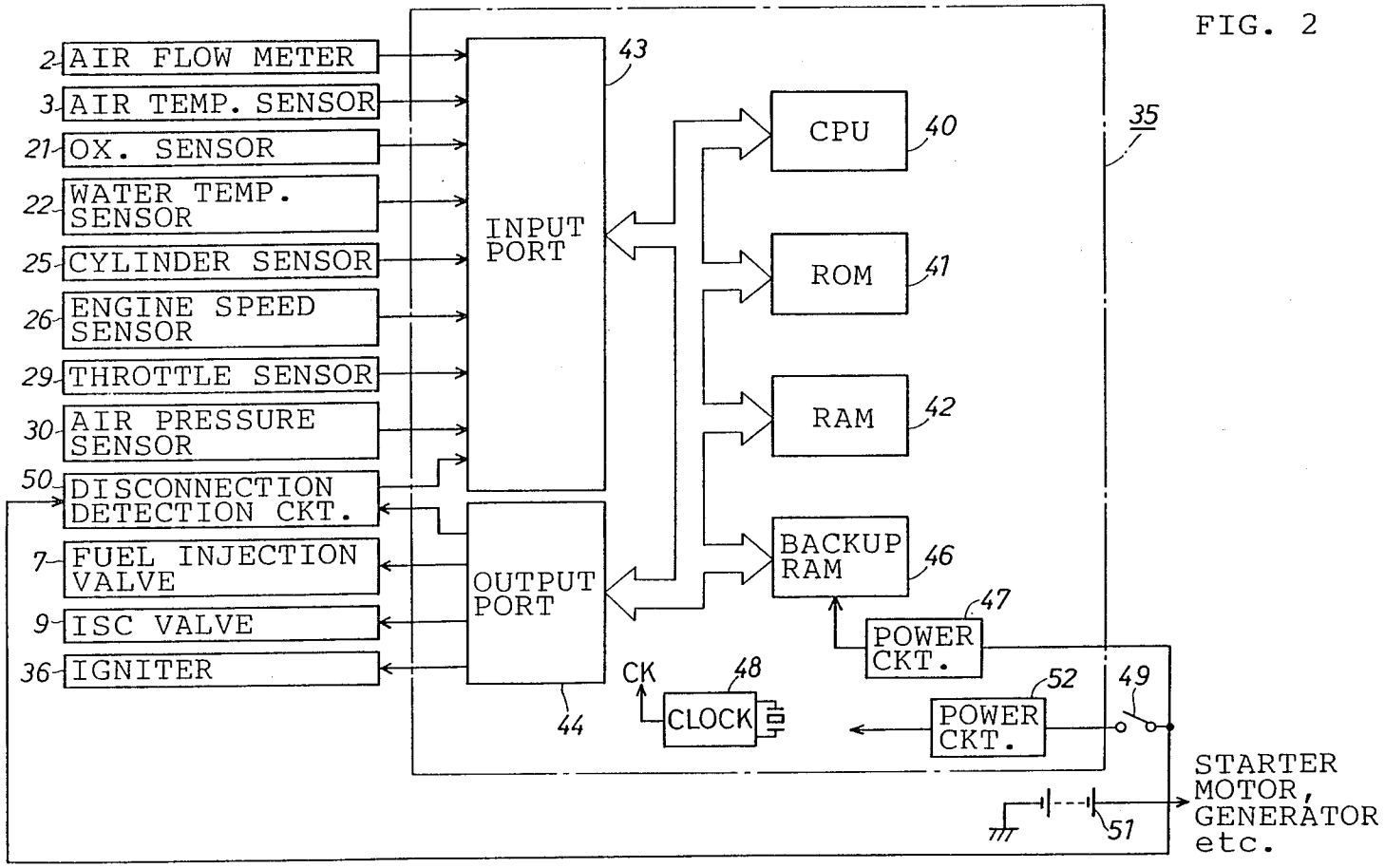
FIG. 2 is a block diagram indicating an electronic controlled circuit of the embodiment.

Set forth is an explanation of the ECU 35. As shown in FIG. 2, the ECU 35 constructs an arithmetic logic circuit by connecting a CPU 40, a ROM 41, a RAM 42, a backup RAM 46, an oscillating circuit 48 for generating clock pulse signals, an input port 43 and an output port 44 by way of a bus 45. The backup RAM 46 is powered by the battery 51 via a power circuit 47.

To the input port 43, there are connected the air flow meter 2, the suction air temperature sensor 3, the oxygen sensor 21, the water temperature sensor 22, the cylinder sensor 25, the rotating speed sensor 26, the throttle sensor 29, the air pressure sensor 30 and the disconnection detection circuit 50.

To the output port 44, there are connected the above-mentioned disconnection detection circuit 50, the fuel injection valve 7, the ISC valve 9 and the ignition coil 36.

The ECU 35 is powered by the battery 51 by way of a key switch 49 and a power circuit 52.

The construction of the disconnection detection circuit 50 will be described with reference to FIG. 3.

The anode of the battery 51 is connected to the collector of an NPN-type transistor Tr1, and also via the resistance R2 to the base of the transistor Tr1. The emitter of the transistor Tr1 is grounded via a resistance R1. Moreover, the anode of the battery 51 is connected via a diode D1 in the forward direction, a resistance R3, a diode D2 in the forward direction, an analogue switch SW1 and a resistance R4 to the input port 43 of the ECU 35 shown in FIG. 2. The collector of a PNP-type transistor Tr2 is grounded via a resistance R5. The emitter of the transistor Tr2 is grounded via a condenser C1, and the base of the transistor Tr2 is connected to the emitter of the transistor Tr1. The power source side of the condenser C1 is connected to the anode of the diode D2. One end of the resistance R4 being connected to the input port 43 is grounded by way of a condenser C2 and is also grounded by way of a resistance R6 and an analogue switch SW2. The gate of the analogue switch SW2 is connected to the output port 44 of the ECU 35 shown in FIG. 2. The gate of the analog switch SW1 is connected to the collector of the transistor Tr2.

Figure 3:
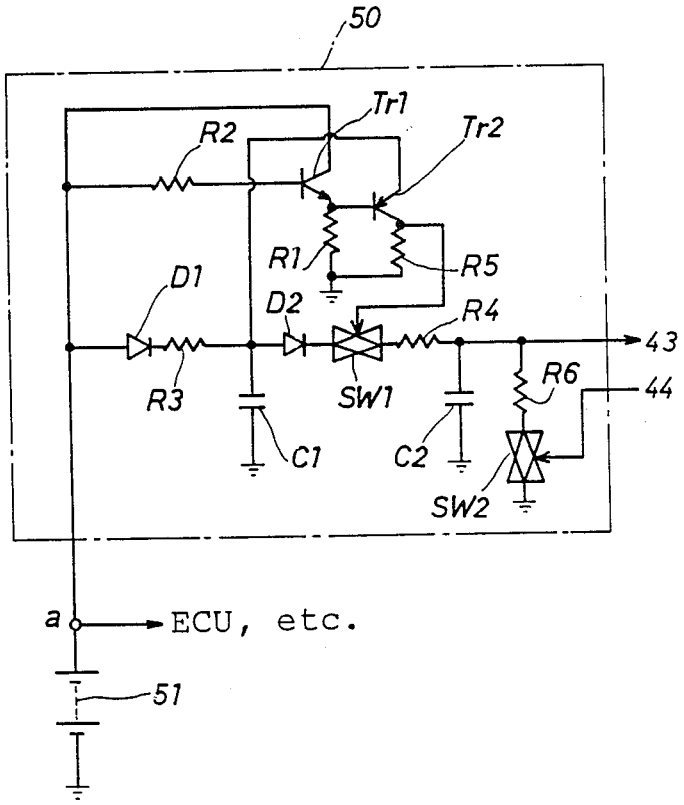
FIG. 3 is a circuit diagram showing a battery disconnection detection circuit according to an embodiment of the present invention.

The disconnection detection circuit 50 acts to set the transistor Tr1 in the ON state when it is connected to the terminal a of the battery 51 shown in FIG. 3. Under this condition, the transistor Tr2 is in the OFF state and the analogue switch SW1 is in a non-conducting state. At this time, the condenser C1 is charged via the diode D1 and the resistance R3. If, on the other hand, the battery 51 is disconnected at the terminal a, the transistor Tr2 is set in the ON state by the transistor Tr1 in the OFF state and the charged condenser C1. In consequence, the analogue switch SW1 is set in a conductive state, and the electrical charge in the condenser C1 is supplied to the condenser C2. As a result, a voltage develops at the condenser C2. This is the information that the battery is disconnected.

The voltage is detected by the ECU 35 via the input port 43 immediately after the power switch 49 is turned ON. When the aforementioned voltage is detected, the ECU 35 recognizes that the battery 51 for supplying power to the backup RAM 46 was somehow disconnected. If, on the other hand, the voltage is not detected, the ECU 35 recognizes the battery 51 has been connected.

After the above-mentioned information is obtained, the ECU 35 sets the analogue switch SW2 in the ON state by sending control signals via the output port 44 so as to discharge the condenser C2. After discharging, the analogue switch SW2 is set in non-conductive state by the ECU 35. The analogue switch SW1 is in a non-conductive state when the battery is connected.

Under the above-mentioned condition, the disconnection detection circuit 50 stores the information that the battery 51 is disconnected. When the signal indicative of the disconnection of the battery is detected by the ECU 35, a reset signal is sent from the ECU 35 to reset the disconnection detection circuit 50.

According to the above-mentioned procedure, the ECU 35 controls respective units connected to the output port 44 based on the input signals of the sensors.

The control programs to be executed by the CPU 40 will be described with reference to the flowcharts of FIGS. 4, 5, 7, 8, 9, 10A and 10B.

Figure 4:
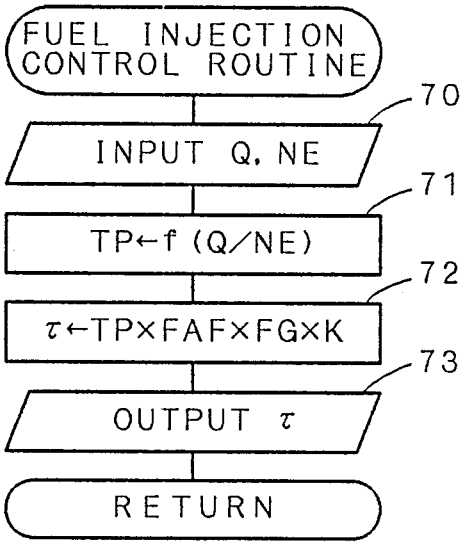
FIG. 4 is a flowchart of a fuel injection control routine to be executed in the embodiment of the present invention.

First, a fuel injecting method of the internal combustion engine according to the present embodiment is set forth based on the flowchart of FIG. 4. This program starts when the ignition switch 49 is turned on. At step 70, an engine speed NE detected by the speed sensor 26 and a suction air amount Q detected by the air flow meter 2 are input. At subsequent step 71, a basic fuel injection time TP is calculated based on the ratio of the suction air amount Q to the engine speed NE. At step 72, a final fuel injection time $\tau$ is calculated in accordance with a formula (1) by utilizing the following values as correction parameters: a feedback correction factor FAF for approaching the actual air/fuel ratio, as determined from the output of the oxygen sensor, to the stoichiometric air/fuel ratio; a learning correction factor FG; and a correction factor K based on the temperatures of the cooling water and the suction air. The learning correction factor FG is obtained from a learning correction factor for compensating the pressure change due to altitude change and a learning correction factor for compensating sluggish action of the air flow meter, under a predetermined condition during execution of the air/fuel ratio feedback control.

$$\tau = TP \cdot FAF \cdot FG \cdot K \ldots \quad (1)$$

Subsequently, the program proceeds to step 73, at which a pulse signal corresponding to the calculated final fuel injection time $\tau$ is generated so as to energize the fuel injection valve 7.

Under the feedback control condition, if the air/fuel ratio is determined to be in fuel lean state based on the output signal of the oxygen sensor 21, the feedback correction factor FAF is set at a value for increasing the fuel injection amount (e.g., 1.05), while if it is determined as in fuel rich state, FAF is set at a value for decreasing the fuel injection amount (e.g., 0.95). On the other hand, if it is not under the feedback control condition, the correction factor FAF is set at 1.0.

Figure 5:
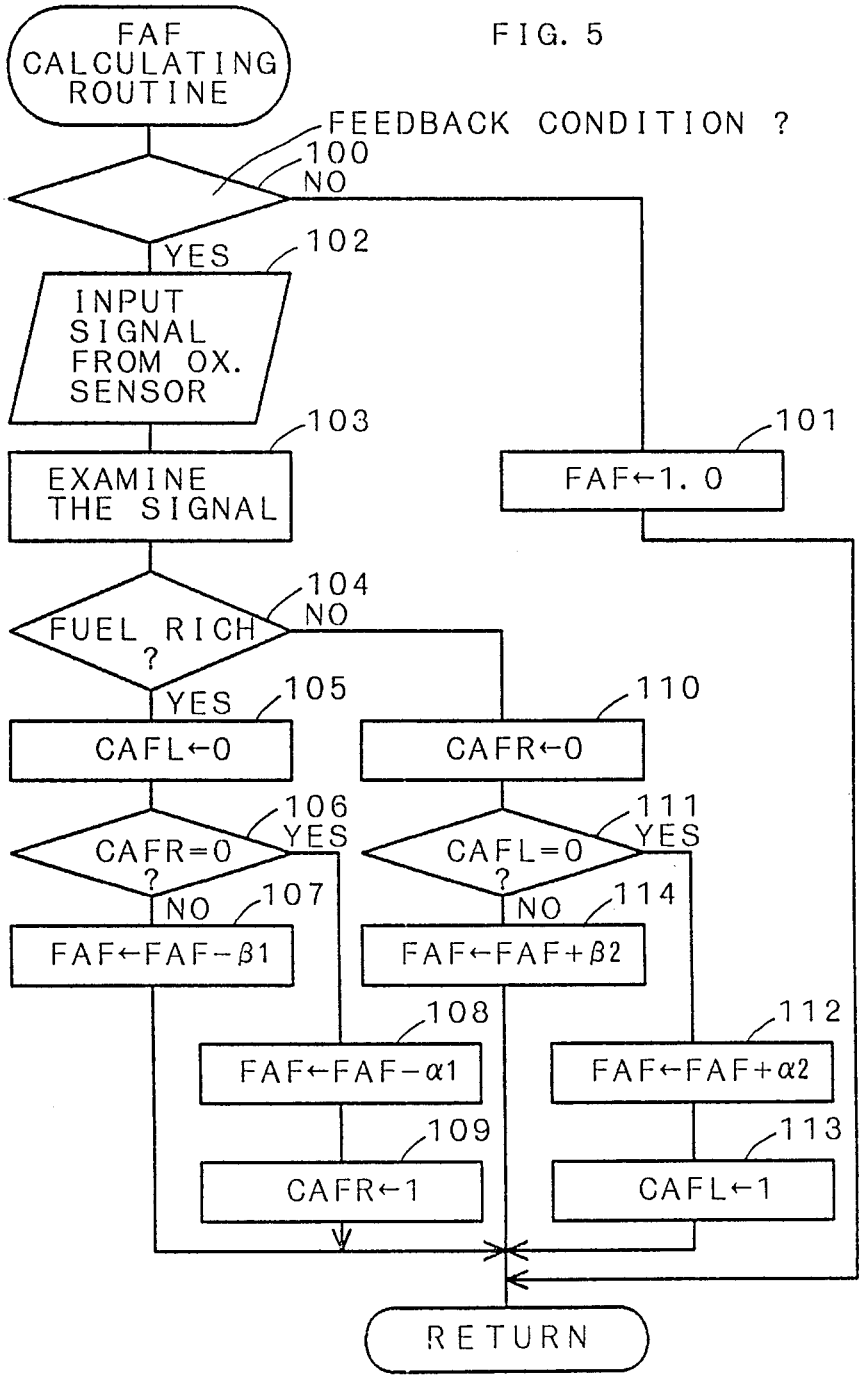
FIG. 5 is a flowchart showing a feedback correction factor calculation routine.

An example of the calculation process of the feedback correction factor FAF is set forth with reference to FIG. 5.

At step 100, it is determined whether or not a feedback condition exists. The feedback condition is defined as a state satisfying all of the following conditions: the engine is not in the starting state; a post-start fuel enrichment is not executed; the water temperature of the engine is higher than 50° C.; and a power enrichment is not executed. If it is determined at step 100 that the feedback condition is not satisfied, the program proceeds to step 101 at which the feedback correction factor FAF is set at 1.0 so that the feedback control will not be executed. Then, the present program is concluded. If, on the other hand, it is determined at step 100 that the feedback control condition is satisfied, the program proceeds to step 102. At this step, the output signal of the oxygen sensor 21 is input. At subsequent step 103, the above-mentioned output signal is examined to determine a lean/rich flag. If the signal indicates the fuel rich state, the flag is set at "1", while if it indicates the fuel lean state, the flag is set at "0". At step 104, it is determined whether the flag is set at "1∞. If YES, the air/fuel ratio is determined as rich so that a control is executed to approach the current air/fuel ratio to the fuel lean side. Namely, the process steps 105 through 109 are executed.

At step 105, a flag CAFL is set at "0". At step 106, it is determined whether or not a flag CAFR is "0". When the air/fuel ratio turns from the fuel lean to the fuel rich side for the first time, the flag CAFR is still "0". In this case, therefore, the program proceeds to step 108 at which the correction factor FAF stored in the RAM 42 is updated by subtracting $\alpha 1$ from the stored FAF. At step 109, the flag CAFR is set at "1". For the second time and after, the program proceeds from step 106 to 107 at which the FAF is updated by subtracting a preset value $\beta 1$ ($\beta 1$ is smaller than $\alpha 1$) from the stored FAF. Thus, the calculation of the correction factor FAF is accomplished.

If, on the other hand, the lean/rich flag is set at "0" at step 104, the air/fuel ratio is determined to be lean so that a control is executed to approach the current air/fuel ratio to the fuel rich side. Namely, the process steps 110 through 114 are executed.

At step 110, the flag CAFR is set at "0". At step 111, it is determined whether or not the flag CAFL is "0". The flag is still "0" when the air/fuel ratio turns from the fuel rich to the fuel lean side for the first time. The program, therefore, proceeds to step 112, where the correction factor FAF is updated by adding a preset value $\alpha 2$ to the stored correction factor FAF. At subsequent step 113, the flag CAFL is set at "1". For the second time and after, the program proceeds from step 111 to 114 where the correction factor FAF is updated by adding a preset value $\beta 2$ ($\beta 2 < \alpha 2$) to the stored correction factor FAF. Thus, the FAF calculation routine is concluded.

Figure 6:
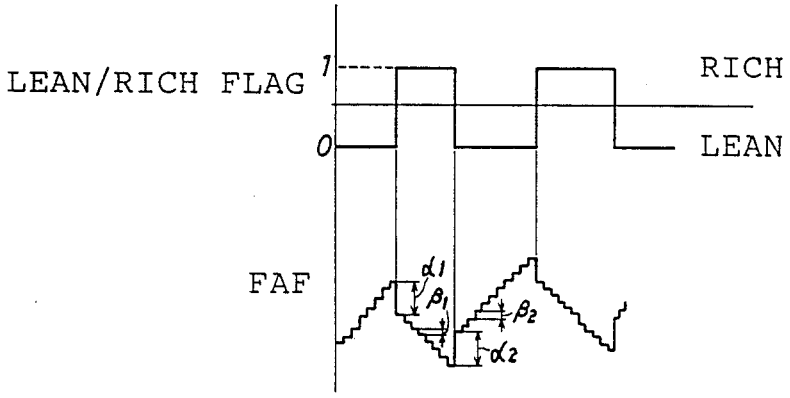
FIG. 6 is a graph indicating a relation between a lean/rich flag corresponding to a signal sent from an oxygen sensor and the feedback correction factor.

The feedback correction factor FAF calculated in the above-mentioned calculation routine with reference to the lean/rich flag illustrated by the graph of FIG. 6. As apparent from the graph, when the air/fuel ratio turns from lean to rich or vice versa, the correction factor FAF jumps by $\alpha 1$ or $\alpha 2$. During the fuel rich state, the smaller value $\alpha 1$ is successively subtracted. During the fuel lean state, the preset value $\beta 2$ is successively added.

The learning correction factor FG according to the control method of the present invention is determined according to the following formula (2).

$$FG=(1+FHAC+DFC/Q) \quad (2),$$

where

FHAC: altitude compensation learning correction factor,

DFC: air flow meter sluggish action compensation learning correction factor and

Q: suction air amount.

The altitude compensation learning correction factor FHAC corresponds to the learning correction factor described in above summary of the invention. The correction factor DFC is used for the compensation of the deviation of the air/fuel ratio caused by sluggish action of the air flow meter due to a secular change.

Figure 7:
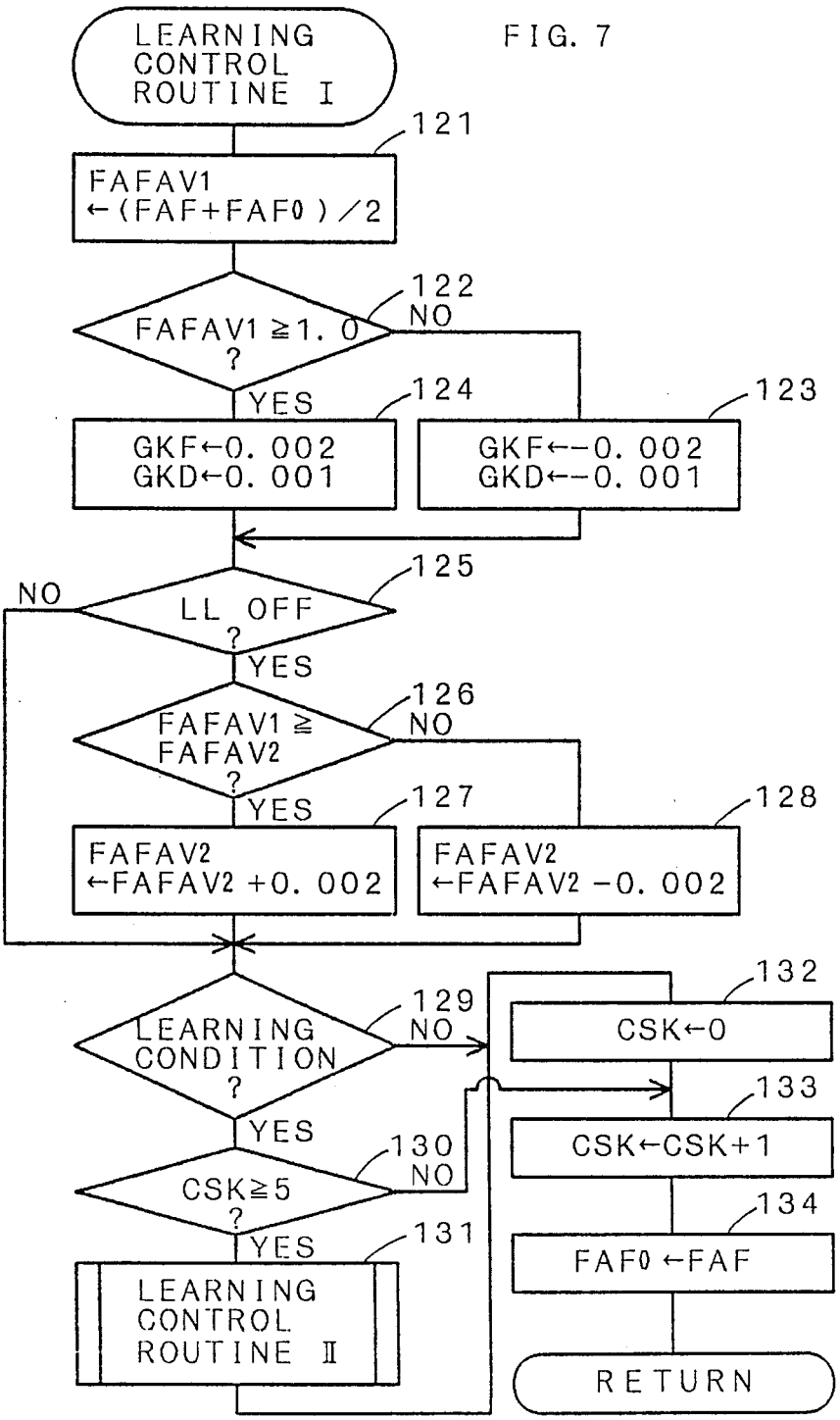
FIGS. 7 and 8 are flowcharts showing examples of a learning control to be executed in the embodiment of the present invention.
Figure 8:
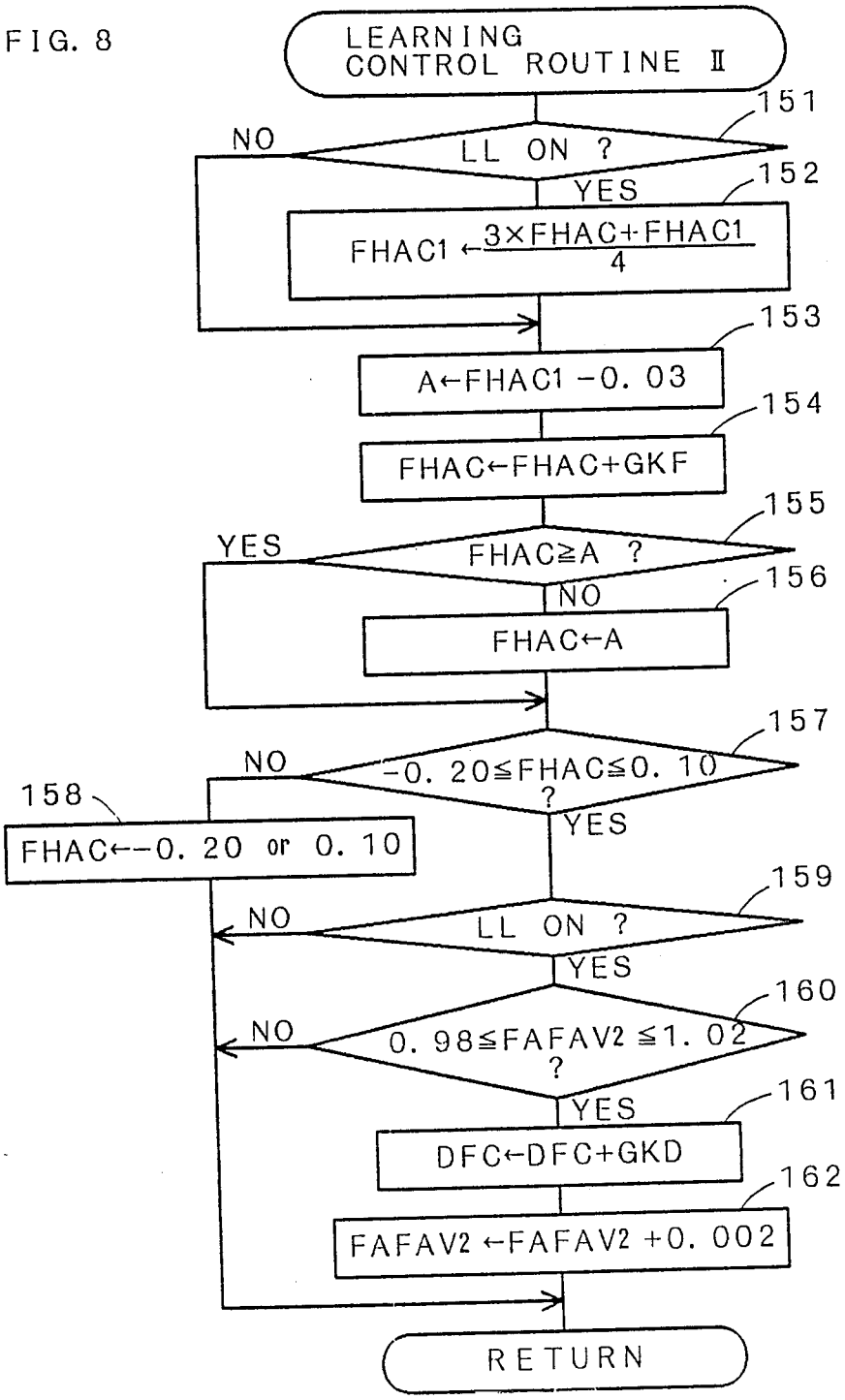
Figure 9:
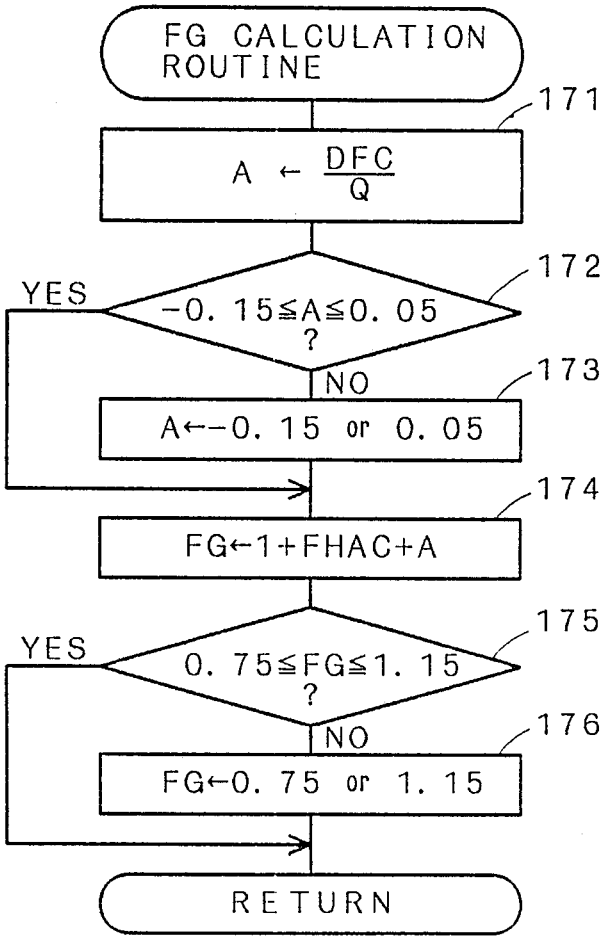
FIG. 9 is a flowchart of a routine for calculating a learning correction factor.

The learning correction factor FG is calculated in accordance with the routines of FIGS. 7, 8 and 9.

A learning control routine I shown in FIG. 7 is executed every time the feedback correction factor FAF jumps by the preset value $\alpha 1$ or $\alpha 2$. At step 121, an arithmetic mean FAFAV1 of the updated correction factor FAF and the former correction factor FAF0 is calculated. At subsequent step 122, it is determined whether FAFAV1 is equal to or larger than 1. If NO, the program proceeds to step 123 at which a variable GKF is set at "−0.002" and another variable GKD at "−0.001". If, on the other hand, the answer at step 122 is YES, the program proceeds to step 124. At this step, the variables GKF and GKD are respectively set at "0.002" and "0.001". The variables GKF and GKD are used in a learning control routine II of FIG. 8 which will be explained later.

At step 125, it is determined whether or not the LL switch is OFF according to the output signal from the LL switch. If YES, i.e., if the throttle valve 4 is not completely closed, the program proceeds to step 126 at which it is determined whether the above-mentioned mean value FAFAV1 is equal to or larger than a reference value FAFAV2. The reference FAFAV2 is set at "1" during initial starting of the engine and is increased or decreased as follows. If the answer is YES at step 126, "0.002" is added to the reference value FAFAV2 at step 127. If NO at step 126, "0.002" is subtracted from FAFAV2 at step 128.

In the case that the answer at step 125 is NO, or that either step 127 or 128 is performed, the program proceeds to step 129. At step 129, it is determined whether or not the learning condition is fulfilled. In determining the learning condition, it is necessary that the feedback control of the air/fuel ratio is under way. In addition to that, for example, it is determined whether the coolant water temperature is equal to or higher than 80° C. If the answer at step 129 is YES, the program proceeds to step 130 at which it is determined whether the value of a counter CSK for counting the number of skipping of the correction factor FAF is equal to or larger than "5". If YES, the learning control routine II shown in FIG. 8 is carried out at step 131. After execution of the learning control routine II, the counter CSK is reset to "0" at step 132.

If, on the other hand, the value of the counter CSK is determined to be smaller than "5" at step 130, or in the case that step 132 is executed, the program proceeds to step 133. At this step, the value of the counter CSK is incremented by "1". At subsequent step 134, the updated correction factor FAF is substituted for the variable FAF0. Thus, the present learning control routine I is completed.

The learning control routine II carried out at step 131 will be described in detail with reference to FIG. 8.

When the learning control routine II is started, it is first determined at step 151 whether the throttle valve 4 is completely closed based on the output signal from the LL switch. Namely, it is determined whether the LL switch is ON. If YES, the program proceeds to step 152, while if NO, it skips to step 153. At step 152, the following computation is executed by utilizing the latest data of the correction factor FHAC stored in the backup RAM 46 and the latest data of a guard value FHAC1 to be calculated only in the case that the LL switch is ON.

$$(3 \cdot FHAC+1 \cdot FHAC1)/4$$

The result of this computation is put in an updated guard value FHAC1.

At step 153, 0.03 is subtracted from the updated guard value FHAC1 which is calculated at step 152, and the result is stored in a register A. At subsequent step 154, the altitude compensating learning amount GKF, which is determined at step 123 or 124 in the learning control routine I of FIG. 7, is added to the correction factor FHAC so as to update the correction factor FHAC. At step 155, it is determined whether the updated correction factor FHAC is equal to or larger than the value "FHAC1−0.03" stored in the register A. If the answer is NO, the program proceeds to step 156 at which the value stored in the register A is put in the correction factor FHAC. If YES at step 155, the program skips to step 157 at which it is determined whether the correction factor FHAC is not less than −0.20 and not more than 0.10 (i.e., $-0.20 \leqq FHAC \leqq 0.10$). If the value of the correction factor FHAC does not fall within the above-mentioned range, FHAC is guarded by a lower or an upper limit value −0.20 or 0.10, i.e., it is fixed at −0.20 or 0.10 so as not to go out of the range. In this case, the present routine is completed at this step without learning the sluggish action compensation learning correction factor DFC. If, on the other hand, the value of the correction factor FHAC belongs to the above-mentioned range, the program proceeds to step 159. At this step, it is determined whether the LL switch is ON. If YES, it is determined at step 160 whether the reference value FAFAV2 is not less than 0.98 and not more than 1.02. If YES, the program proceeds to step 161 at which the sluggish action compensating learning amount GKD, which is set at step 123 or 124 in the learning control routine I of FIG. 7, is added to the sluggish action compensating learning correction factor DFC. At subsequent step 162, 0.002 is added to the reference value FAFAV2. Then, the present routine is completed.

A calculation routine of the learning correction factor FG to be used in the calculation of the fuel injection time $\tau$ will be set forth with reference to FIG. 9.

At the first step 171 of the present routine, the updated correction factor DFC, which is obtained at step 161 in the learning control routine II of FIG. 8, is divided by the suction air amount Q per unit time. The amount Q is determined based on the output signal of the air flow meter 2. The result of DFC/Q is stored in the register A. At subsequent step 172, it is determined whether the value DFC/Q stored in the register A is not less than −0.15 and not more than 0.05 (−0.15≦DFC/Q≦0.05). If the value DFC/Q is outside of the above-mentioned range, the value is fixed at −0.15 or 0.05 at step 173 and the program proceeds to step 174. On the other hand, if the value DFC/Q falls within the above-mentioned range at step 172, the program skips to step 174.

At step 174, the learning correction factor FG is determined by the sum of 1 plus the updated correction factor FHAC obtained at step 156 or 158 in the routine of FIG. 8 plus the value stored in the register A (i.e., FG=1+FHAC +A). At step 175, it is determined whether the learning correction factor FG is not less than 0.75 and not more than 1.15 (0.75≦FG≦1.15). If YES, the present routine is accomplished at this step. If NO, the learning correction factor FG is fixed at 0.75 or 1.15 at step 176. Then, the present routine is concluded.

The feedback correction factor FAF and the learning correction factor FG are calculated according to the above-mentioned procedure. By utilizing these factors FAF and FG, the process step 72 shown in FIG. 4 is carried out.

Figure 10A:
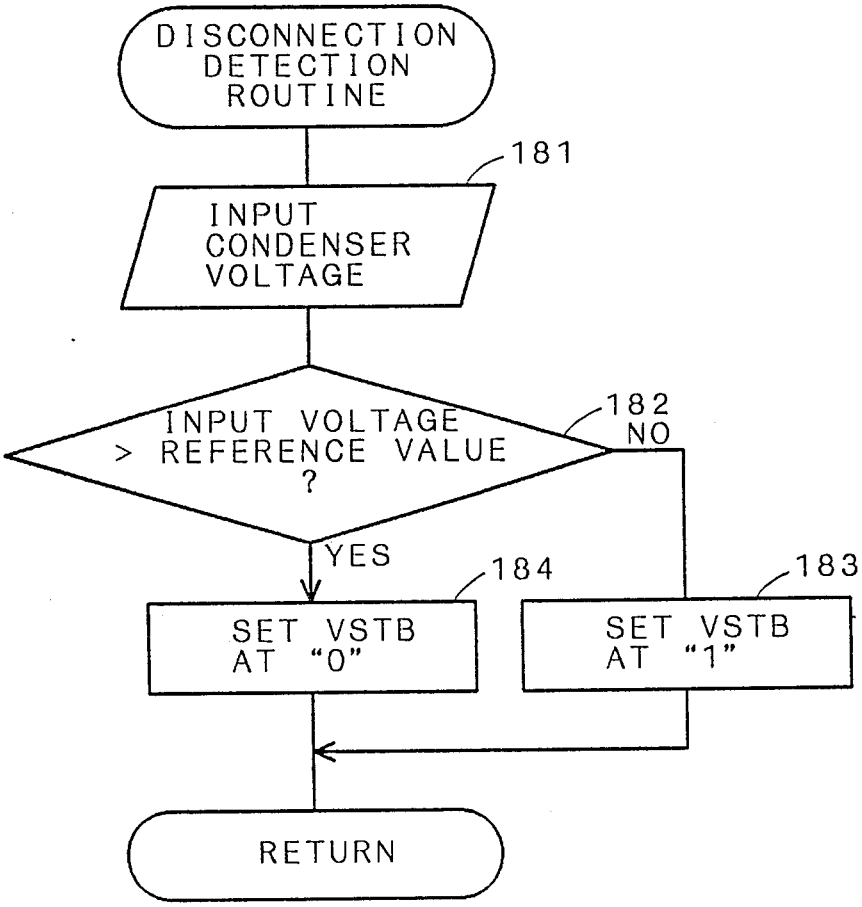
FIG. 10A is a flowchart showing a process routine for detecting disconnection of a battery.
Figure 10B:
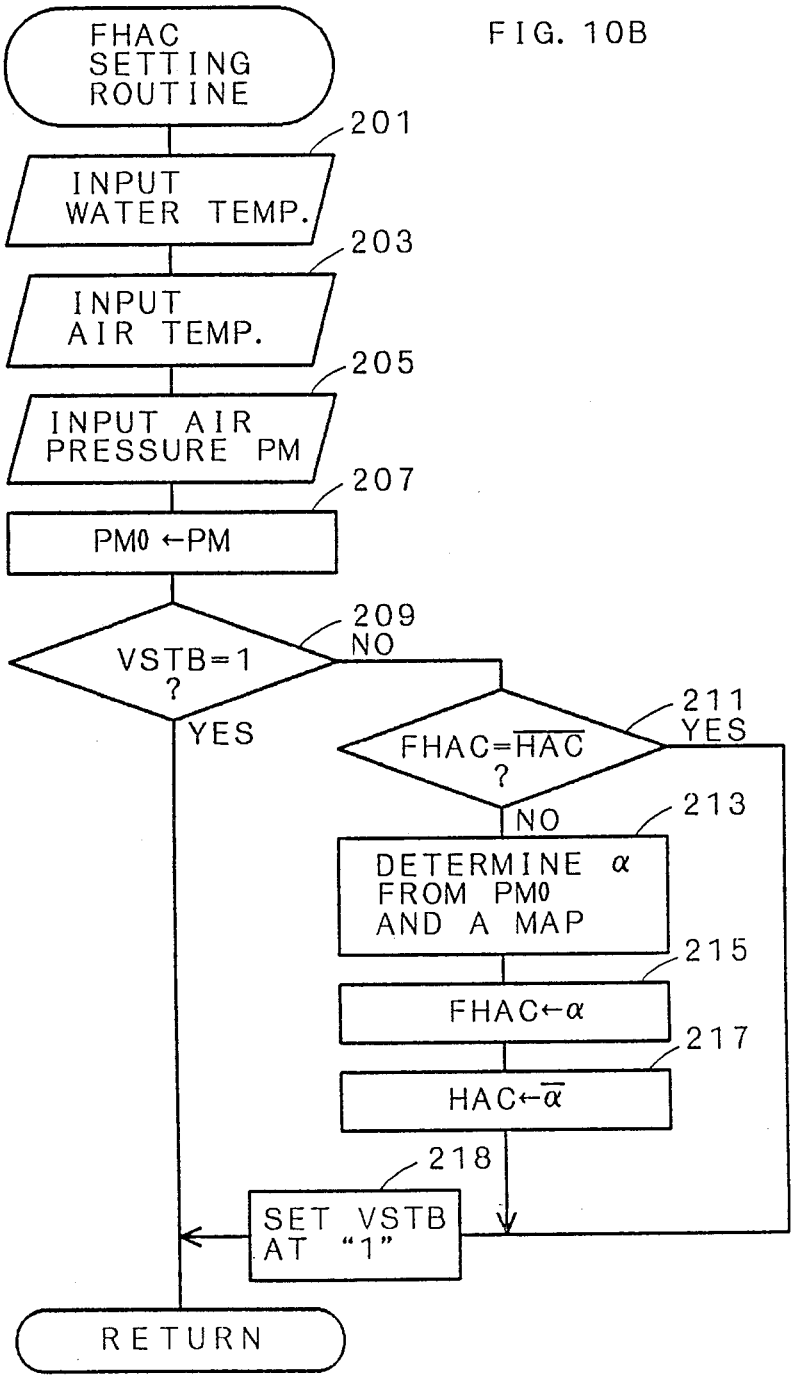
FIG. 10B is a flowchart of a process routine for setting an altitude compensating learning correction factor.

The battery disconnection detection routine and the routine for setting the altitude compensating learning correction factor will be next described respectively based on FIGS. 10A and 10B. These routines are executed in order to reset the learning correction factor after the battery disconnection detection circuit 50 detects the loss of the altitude compensating learning correction factor stored in the backup RAM 46.

The battery disconnection detection routine shown in FIG. 10A is executed once, each time the key switch (power switch) is turned on. The FHAC setting routine shown in 10B is executed once, after the above-mentioned battery disconnection detection routine is accomplished.

The battery disconnection detection routine is described first. At step 181, the voltage of the condenser C2 in the battery disconnection detection circuit 50 is input. At subsequent step 182, it is determined whether the input voltage of the condenser C2 is higher than a preset reference value. Namely, it is determined whether the battery was disconnected at any time since the key switch was last operated. If YES, the program proceeds to step 184 at which a flag VSTB is set at "0" and the present routine is concluded. If NO at step 182, namely, if it is determined the battery was not disconnected, the flag VSTB is set at "1" at step 183. Then, the present routine is concluded. After the above-mentioned routine is accomplished, the FHAC setting routine shown in FIG. 10B is carried out.

The FHAC setting routine is set forth below. At first step 201 of the present routine, the coolant water temperature is detected by the water temperature sensor 22 shown in FIG. 1. Subsequently, the suction air temperature is detected by the suction air temperature sensor 3 at step 203. At step 205, the atmospheric pressure PM is input from the pressure sensor 30, and the input pressure PM is put in a variable PM0. At step 209, it is determined, with reference to the value of the flag VSTB set in the aforementioned disconnection detection routine, whether the battery has been disconnected. When the flag VSTB is "1", it is determined that no battery disconnection has occurred, and the present routine is concluded. On the other hand, when the flag VSTB is "0", the program proceeds to step 211. At this step, it is determined whether the altitude compensating learning correction factor FHAC stored in the backup RAM 46 is equal to an inversion $\overline{HAC}$ of the above-mentioned correction factor FHAC to be set at step 217. The purpose of the determination step 211 is to ascertain whether power from the battery actually has been discontinued, with reference to the data stored in the backup RAM 46. If power from the battery has been discontinued, the content of the data stored in the backup RAM 46 becomes indefinite so that the value of the correction factor FHAC is not equal to the inversion $\overline{HAC}$ For the memory check at step 211, it is possible to use any other optional value instead of the correction factor FHAC to be set at step 215 and the inversion HAC of FHAC to be set at step 217.

Figure 11:
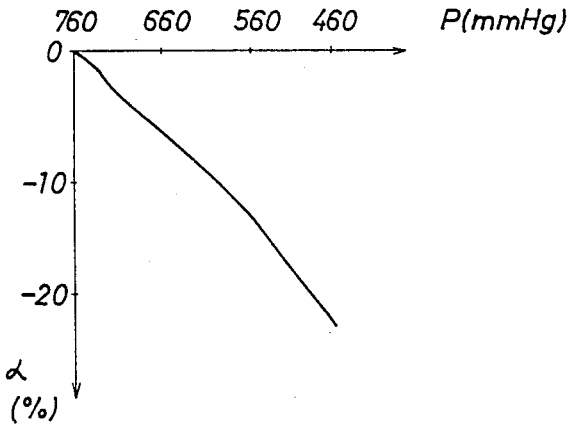
FIG. 11 is a graph indicating a relation between the atmospheric pressure and the altitude compensating amount according to the embodiment of the present invention.

On the other hand, if the value of FHAC is determined to be equal to the inversion $\overline{HAC}$ at step 211, it is assumed that the flag VSTB is set at "0" due to some accident during setting the flag VSTB or other trouble in the memory storing the flag or abnormal operation of the battery disconnection detection circuit 50. In such a case, the program proceeds to step 218 at which the flag VSTB is set at "1". Then, the present routine is concluded. If the correction factor FHAC is not equal to the inversion $\overline{HAC}$ at step 211, the program proceeds to step 213. At this step, a standard altitude compensating factor $\alpha$ is determined based on the atmospheric pressure PM0 obtained at step 207 with reference to the predetermined graph of FIG. 11. The standard altitude compensating factor $\alpha$ may be obtained based on a predetermined formula relating atmospheric pressure and the altitude compensating factor $\alpha$. At subsequent step 215, the standard altitude compensating factor $\alpha$ calculated at step 213 is substituted for the altitude compensating learning correction factor FHAC and it is stored in the backup RAM 46. At step 217, the inversion $\bar{\alpha}$ of the standard altitude compensating factor $\alpha$ is substituted for the variable HAC. The inversion is made by inverting every bit of a binary number of 8 bits representing the value $\alpha$. The value is stored in the backup RAM 46. Then, the program proceeds to step 218 at which the flag VSTB is set at "1". After step 218, the present routine is concluded.

As described in the above, in the present embodiment, the disconnection of the battery is ascertained twice before the engine is started. First by utilizing the battery disconnection detection circuit 50. Second, the altitude compensating learning correction factor FHAC stored in the backup RAM 46 is compared with the inversion $\overline{HAC}$ in order to check the content of the memory of the backup RAM 46. After going through the double check, the altitude compensation learning correction factor FHAC is calculated based on the atmospheric pressure and is stored in the backup RAM 46. Subsequently, the learning correction factor FG is calculated by utilizing the above-mentioned FHAC in accordance with the formula (2). Based on the calculated FG, the final fuel injection time $\tau$ is calculated by the formula (1). The fuel injection valve 7 is actuated in response to the fuel injection pulse signal corresponding to the fuel injection time $\tau$.

Even though the battery is disconnected for replacement or charging, so that power supply to the backup RAM 46 for storing the altitude compensating learning correction factor corresponding to the atmospheric pressure change is discontinued, namely, even if the data stored in the memory of the backup RAM 46 is lost, the battery disconnection is detected before the engine is started and the altitude compensating learning correction factor corresponding to the atmospheric pressure is reset and stored in the backup RAM 46. Accordingly, the fuel injection amount can be accurately corrected based on the newly stored correction factor from the initial cranking of the engine. Thus, the air/fuel ratio can be immediately controlled to approach a desired ratio.

Moreover, in the present embodiment, incorrect determination of battery disconnection can be prevented since the disconnection of the battery 51 for supplying power to the backup RAM 46 is ascertained twice, first by detecting the output voltage of the battery disconnection detection circuit 50 and then by confirming whether the memory of the backup RAM 46 is correctly working.

While the invention has been practically shown and described with reference to a preferred embodiment, it will be understood by those skilled in the art that various other modifications may be made without departing from the spirit and scope of the invention. For example, at step 205, it is possible to detect the atmospheric pressure by an intake pipe pressure sensor (not shown in FIG. 1) which is installed for a sophisticated engine control, rather than providing special atmospheric pressure air sensor 30. The suction air pressure before cranking is equal to the atmospheric pressure. Moreover, in the flow of the process steps 209 through 213, steps 211 and 217 may be omitted if there is no need to detect incorrect setting of the flag VSTB or other abnormal states.

What is claimed is:

1. A fuel injection system for an internal combustion engine comprising:

an air flow meter for measuring a suction air amount;

an engine speed sensor for sensing a rotating speed of the engine;

basic amount calculation means responsive to the sensed suction air amount and the sensed engine speed for calculating a basic fuel injecting amount for realizing a given target air/fuel ratio in a combustion chamber of the engine;

an oxygen sensor for sensing an oxygen content of an exhaust gas of the engine;

a memory for storing a learning correction factor, the memory being backed up by a battery;

correction factor calculation means for calculating the learning correction factor based on the sensed oxygen content and the previously calculated learning correction factor stored in the memory in order to compensate a deviation from the target air/fuel ratio due to a change in an atmospheric pressure;

injecting amount calculation means for calculating a fuel injecting amount of the engine based on the basic fuel injecting amount and the learning correction factor;

disconnection detection means for detecting a disconnection between the memory and the battery when the engine is not operating;

an air pressure sensor for sensing the atmospheric pressure; and correction factor setting means for setting an initial learning correction factor based on the sensed atmospheric pressure and for storing the initial learning correction factor in the memory before the engine is started when a connection between the memory and the battery is restored after the disconnection is detected.

2. The fuel injection system according to claim 1 wherein the disconnection detection means comprises a first condenser (C1), a second condenser (C2), a first transistor (Tr1) and a second transistor (Tr2), the first condenser being connected to the battery and the second condenser being charged an electrical charge of the first condenser by a switching action of the first and the second transistors when the battery is disconnected from the first condenser, the electrical charge of the second condenser representing the disconnection between the memory and the battery.

3. The fuel injection system according to claim 2 wherein the fuel injection system further comprises confirming means for confirming whether the disconnection has occurred by checking contents of the memory.

4. The fuel injection system according to claim 3 wherein the correction factor setting means determines the initial learning correction factor utilizing a map representing a predetermined optimal relation between the atmospheric pressure and the initial learning correction factor, the map being stored in a read only memory.

5. A method for determining a fuel injection amount of an internal combustion engine comprising steps of:

calculating a basic fuel injecting amount based on a sensed suction air amount, a sensed engine speed and a given target air/fuel ratio;

calculating a learning correction factor based on a previously calculated learning correction factor and sensed oxygen content of an exhaust gas of the engine for compensating a deviation from the target air/fuel ratio due to a change in atmospheric pressure, the calculated learning correction factor being stored in a memory backed up by a battery for use in a next time calculation;

calculating the fuel injecting amount based on the basic fuel injection amount and the learning correction factor;

detecting a disconnection between the memory and the battery when the engine is not operating;

sensing the atmospheric pressure;

setting an initial learning correction factor based on the sensed atmospheric pressure after a connection between the memory and the battery is restored and before the engine is started; and storing the initial learning correction factor in the memory.

6. The method according to claim 5 wherein the method further comprises a step of confirming whether the disconnection has occurred by checking contents of the memory after the detecting step.

7. The method according to claim 6 wherein the initial learning correction factor is determined utilizing a map representing a predetermined optimal relation between the atmospheric pressure and the initial learning correction factor and stored in a read only memory in the setting step.

* * * * *